US011151924B2

(12) United States Patent
Roh et al.

(10) Patent No.: US 11,151,924 B2
(45) Date of Patent: Oct. 19, 2021

(54) DISPLAY DEVICE DISPLAYING AN IMAGE BY DECODING A COMPRESSED IMAGE BITSTREAM, AND METHOD OF OPERATING THE DISPLAY DEVICE

(71) Applicant: Samsung Display Co., Ltd., Yongin-si (KR)

(72) Inventors: Jinyoung Roh, Hwaseong-si (KR); Sangan Kwon, Cheonan-si (KR); Sehyuk Park, Seongnam-si (KR); Hyo Jin Lee, Yongin-si (KR); HongSoo Kim, Hwaseong-si (KR); Sukhun Lee, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 35 days.

(21) Appl. No.: 16/828,726

(22) Filed: Mar. 24, 2020

(65) Prior Publication Data

US 2021/0005130 A1 Jan. 7, 2021

(30) Foreign Application Priority Data

Jul. 3, 2019 (KR) ..... 10-2019-0080384

(51) Int. Cl.
*G09G 5/393* (2006.01)
*G09G 3/20* (2006.01)

(52) U.S. Cl.
CPC ..... *G09G 3/2037* (2013.01); *G09G 5/393* (2013.01); *G09G 2340/16* (2013.01); *G09G 2360/12* (2013.01)

(58) Field of Classification Search
CPC .... G09G 3/2037; G09G 3/2096; G09G 5/393; G09G 2340/16; G09G 2320/103; G09G 2340/02; G09G 2360/12
See application file for complete search history.

(56) References Cited

U.S. PATENT DOCUMENTS

2013/0136178 A1* 5/2013 Sasai ..... H04N 19/103 375/240.12

FOREIGN PATENT DOCUMENTS

| | | | |
|---|---|---|---|
| KR | 10-0618191 | B1 | 9/2006 |
| KR | 10-2015-0042621 | A | 4/2015 |
| KR | 10-1910110 | B1 | 12/2018 |
| KR | 10-1954947 | B1 | 3/2019 |

* cited by examiner

*Primary Examiner* — Robert J Michaud
(74) *Attorney, Agent, or Firm* — Lewis Roca Rothgerber Christie LLP

(57) ABSTRACT

A display driver includes a still image detector configured to receive a compressed image bitstream at an input frame frequency from a host processor, and to detect a still image by comparing the compressed image bitstream of a current frame and the compressed image bitstream of a previous frame, a driving frequency changer configured to output the compressed image bitstream at a first output frame frequency equal to the input frame frequency when the still image is not detected, and to output the compressed image bitstream at a second output frame frequency lower than the input frame frequency when the still image is detected, and a decoder configured to generate original image data at the first output frame frequency and the second output frame frequency.

20 Claims, 11 Drawing Sheets

DISPLAY DEVICE DISPLAYING AN IMAGE BY DECODING A COMPRESSED IMAGE BITSTREAM, AND METHOD OF OPERATING THE DISPLAY DEVICE

CROSS-REFERENCE TO RELATED APPLICATION

The present application claims priority to and the benefit of Korean Patent Application No. 10-2019-0080384, filed on Jul. 3, 2019 in the Korean Intellectual Property Office (KIPO), the entire content of which is incorporated herein in its entirety by reference.

BACKGROUND

1. Field

Aspects of some example embodiments of the present inventive concept relate to a display device, and for example, to a display device configured to display an image by decoding a compressed image bitstream, and a method of operating the display device.

2. Description of the Related Art

Reduction of or efficient power consumption may be desirable in a display device employed in a portable device, such as a smartphone, a tablet computer, etc. Recently, in order to reduce the power consumption of the display device, a low frequency driving technique, which drives or refreshes a display panel at a frequency lower than an input frame frequency of input image data, has been developed.

However, in a display device receiving a compressed image bitstream from a host processor, although a display panel may be driven at a frequency lower than an input frame frequency, the compressed image bitstream may be decoded at the input frame frequency, and thus additional power may be consumed in decoding the compressed image bitstream.

The above information disclosed in this Background section is only for enhancement of understanding of the background and therefore the information discussed in this Background section does not necessarily constitute prior art.

SUMMARY

Some example embodiments include a display device capable of reducing power consumption, or consuming power relatively efficiently.

Some example embodiments include a method of operating a display device that may be capable of reducing power consumption, or consuming power relatively efficiently.

According to some example embodiments, a display device includes a display panel including a plurality of pixels, and a display driver configured to drive the display panel. The display driver includes a still image detector configured to receive a compressed image bitstream at an input frame frequency from a host processor, and to detect a still image by comparing the compressed image bitstream of a current frame and the compressed image bitstream of a previous frame, a driving frequency changer configured to output the compressed image bitstream at a first output frame frequency substantially a same as the input frame frequency when the still image is not detected, and to output the compressed image bitstream at a second output frame frequency lower than the input frame frequency when the still image is detected, and a decoder configured to generate original image data at the first output frame frequency by decoding the compressed image bitstream at the first output frame frequency when the still image is not detected, and to generate the original image data at the second output frame frequency by decoding the compressed image bitstream at the second output frame frequency when the still image is detected.

According to some example embodiments, the still image detector may include a bitstream memory configured to store the compressed image bitstream of the previous frame, and a still image detecting unit configured to compare the compressed image bitstream of the current frame received from the host processor and the compressed image bitstream of the previous frame stored in the bitstream memory, to determine that the still image is not detected when the compressed image bitstream of the current frame is different from the compressed image bitstream of the previous frame, and to determine that the still image is detected when the compressed image bitstream of the current frame is substantially a same as the compressed image bitstream of the previous frame.

According to some example embodiments, the still image detector may include a representative value register configured to store a previous representative value of the compressed image bitstream of the previous frame, and a still image detecting unit configured to calculate a current representative value of the compressed image bitstream of the current frame received from the host processor, to compare the current representative value and the previous representative value stored in the representative value register, to determine that the still image is not detected when the current representative value is different from the previous representative value, and to determine that the still image is detected when the current representative value is substantially a same as the previous representative value.

According to some example embodiments, when the still image is not detected, the driving frequency changer may output the compressed image bitstream of N frames while the compressed image bitstream of the N frames is input, where N is an integer greater than 1. When the still image is detected, the driving frequency changer may output the compressed image bitstream of M frames while the compressed image bitstream of the N frames is input, where M is an integer greater than 0 and less than N.

According to some example embodiments, the input frame frequency may be K Hz, and the second output frame frequency may be L Hz, where K is an integer greater than 1, and L is an integer greater than 0 and less than K. When the still image is not detected, the driving frequency changer may output the compressed image bitstream of K frames for 1 second. When the still image is detected, the driving frequency changer may output the compressed image bitstream of L frames for 1 second, and may not output the compressed image bitstream of K-L frames for the 1 second.

According to some example embodiments, the decoder may include a rate buffer configured to temporarily store the compressed image bitstream, a substream demultiplexing unit configured to generate a plurality of substream data for a luminance component, a first chrominance component and a second chrominance component by demultiplexing the compressed image bitstream, an entropy decoding unit configured to generate at least one of residual values, indexed color history (ICH) index data, or flatness information by performing entropy decoding on the plurality of substream data, a rate control unit configured to determine a quantization parameter based on at least one of a number of bits used in a current prediction or the flatness information, a prediction-inverse quantization-reconstruction unit configured to generate prediction values for a pixel group, to inverse quantize the residual values from the entropy decoding unit based on the quantization parameter, and to generate pixel values for the pixel group by adding the inverse quantized residual values to the prediction values, an ICH unit configured to perform ICH decoding for the pixel group based on the ICH index data from the entropy decoding unit, a line buffer configured to store the pixel values for a previous line, and an image format converter configured to generate the original image data by converting a format of the pixel values output from the prediction-inverse quantization-reconstruction unit.

According to some example embodiments, a display device includes a display panel including a plurality of pixels, and a display driver configured to drive the display panel. The display driver includes a variable frequency decoder configured to receive a compressed image bitstream at an input frame frequency from a host processor, to generate a plurality of substream data by demultiplexing the compressed image bitstream, to detect a still image by comparing at least one of the plurality of substream data of a current frame and at least one of the plurality of substream data of a previous frame, to generate original image data at a first output frame frequency substantially a same as the input frame frequency by decoding the plurality of substream data at the first output frame frequency when the still image is not detected, and to generate the original image data at a second output frame frequency lower than the input frame frequency by decoding the plurality of substream data at the second output frame frequency when the still image is detected.

According to some example embodiments, the variable frequency decoder may include a substream demultiplexing unit configured to generate the plurality of substream data for a luminance component, a first chrominance component and a second chrominance component by demultiplexing the compressed image bitstream, a substream memory configured to store the at least one of the plurality of substream data of the previous frame, a still image detecting unit configured to compare the at least one of the plurality of substream data of the current frame received from the substream demultiplexing unit and the at least one of the plurality of substream data of the previous frame stored in the substream memory, to determine that the still image is not detected when the at least one of the plurality of substream data of the current frame is different from the at least one of the plurality of substream data of the previous frame, and to determine that the still image is detected when the at least one of the plurality of substream data of the current frame is substantially a same as the at least one of the plurality of substream data of the previous frame, a driving frequency changing unit configured to output the plurality of substream data at the first output frame frequency when the still image is not detected, and to output the plurality of substream data at the second output frame frequency when the still image is detected, and a substream decoding unit configured to generate the original image data at the first output frame frequency by decoding the plurality of substream data at the first output frame frequency when the still image is not detected, and to generate the original image data at the second output frame frequency by decoding the plurality of substream data at the second output frame frequency when the still image is detected.

According to some example embodiments, when the still image is not detected, the driving frequency changing unit may output the plurality of substream data of N frames while the plurality of substream data of the N frames is input, where N is an integer greater than 1. When the still image is detected, the driving frequency changing unit may output the plurality of substream data of M frames while the plurality of substream data of the N frames is input, where M is an integer greater than 0 and less than N.

According to some example embodiments, the input frame frequency may be K Hz, and the second output frame frequency may be L Hz, where K is an integer greater than 1, and L is an integer greater than 0 and less than K. When the still image is not detected, the driving frequency changing unit may output the plurality of substream data of K frames for 1 second. When the still image is detected, the driving frequency changing unit may output the plurality of substream data of L frames for 1 second, and may not output the plurality of substream data of K-L frames for the 1 second.

According to some example embodiments, the variable frequency decoder may further include a rate buffer configured to temporarily store the compressed image bitstream received from the host processor, and to output the temporarily stored compressed image bitstream to the substream demultiplexing unit.

According to some example embodiments, the substream decoding unit may include an entropy decoding unit configured to generate at least one of residual values, indexed color history (ICH) index data and flatness information by performing entropy decoding on the plurality of substream data, a rate control unit configured to determine a quantization parameter based on at least one of a number of bits used in a current prediction and the flatness information, a prediction-inverse quantization-reconstruction unit configured to generate prediction values for a pixel group, to inverse quantize the residual values from the entropy decoding unit based on the quantization parameter, and to generate pixel values for the pixel group by adding the inverse quantized residual values to the prediction values, an ICH unit configured to perform ICH decoding for the pixel group based on the ICH index data from the entropy decoding unit, a line buffer configured to store the pixel values for a previous line, and an image format converter configured to generate the original image data by converting a format of the pixel values output from the prediction-inverse quantization-reconstruction unit.

According to some example embodiments, the variable frequency decoder may include a substream demultiplexing unit configured to generate the plurality of substream data for a luminance component, a first chrominance component and a second chrominance component by demultiplexing the compressed image bitstream, a representative value register configured to store a previous representative value of the at least one of the plurality of substream data of the previous frame, a still image detecting unit configured to calculate a current representative value of the at least one of the plurality of substream data of the current frame received from the substream demultiplexing unit, to compare the current representative value and the previous representative value stored in the representative value register, to determine that the still image is not detected when the current representative value is different from the previous representative value, and to determine that the still image is detected when the current representative value is substantially a same as the previous representative value, a driving frequency changing unit configured to output the plurality of substream data at the first output frame frequency when the still image is not detected, and to output the plurality of substream data at the second output frame frequency when the still image is detected, and a substream decoding unit configured to generate the original image data at the first output frame frequency by decoding the plurality of substream data at the first output frame frequency when the still image is not detected, and to generate the original image data at the second output frame frequency by decoding the plurality of substream data at the second output frame frequency when the still image is detected.

According to some example embodiments, there is provided a method of operating a display device. In the method, a compressed image bitstream is received at an input frame frequency from a host processor, a still image is detected by comparing the compressed image bitstream of a current frame and the compressed image bitstream of a previous frame, original image data are generated at a first output frame frequency substantially a same as the input frame frequency by decoding the compressed image bitstream at the first output frame frequency when the still image is not detected, the original image data are generated at a second output frame frequency lower than the input frame frequency by decoding the compressed image bitstream at the second output frame frequency when the still image is detected, and an image is displayed based on the original image data.

According to some example embodiments, to detect the still image, the compressed image bitstream of the previous frame may be stored in a bitstream memory, the compressed image bitstream of the current frame received from the host processor and the compressed image bitstream of the previous frame stored in the bitstream memory may be compared, it may be determined that the still image is not detected when the compressed image bitstream of the current frame is different from the compressed image bitstream of the previous frame, and it may be determined that the still image is detected when the compressed image bitstream of the current frame is substantially a same as the compressed image bitstream of the previous frame.

According to some example embodiments, to detect the still image, a previous representative value of the compressed image bitstream of the previous frame may be stored in a representative value register, a current representative value of the compressed image bitstream of the current frame received from the host processor may be calculated, the current representative value and the previous representative value stored in the representative value register may be compared, it may be determined that the still image is not detected when the current representative value is different from the previous representative value, and it may be determined that the still image is detected when the current representative value is substantially a same as the previous representative value.

According to some example embodiments, to detect the still image, a plurality of substream data may be generated by demultiplexing the compressed image bitstream, at least one of the plurality of substream data of the previous frame may be stored in a substream memory, at least one of the plurality of substream data of the current frame and the at least one of the plurality of substream data of the previous frame stored in the substream memory may be compared, it may be determined that the still image is not detected when the at least one of the plurality of substream data of the current frame is different from the at least one of the plurality of substream data of the previous frame, and it may be determined that the still image is detected when the at least one of the plurality of substream data of the current frame is substantially a same as the at least one of the plurality of substream data of the previous frame.

According to some example embodiments, to detect the still image, a plurality of substream data may be generated by demultiplexing the compressed image bitstream, a previous representative value of at least one of the plurality of substream data of the previous frame may be stored in a representative value register, a current representative value of at least one of the plurality of substream data of the current frame may be calculated, the current representative value and the previous representative value stored in the representative value register may be compared, it may be determined that the still image is not detected when the current representative value is different from the previous representative value, and it may be determined that the still image is detected when the current representative value is substantially a same as the previous representative value.

According to some example embodiments, the compressed image bitstream of N frames may be received for a first time, where N is an integer greater than 1. To generate the original image data at the second output frame frequency, the compressed image bitstream of M frames may be output for the first time, where M is an integer greater than 0 and less than N, and the original image data of the M frames may be generated by decoding the compressed image bitstream of the M frames for the first time.

According to some example embodiments, the input frame frequency may be K Hz, and the second output frame frequency may be L Hz, where K is an integer greater than 1, and L is an integer greater than 0 and less than K. To generate the original image data at the second output frame frequency, the compressed image bitstream of L frames may be output for 1 second, the compressed image bitstream of K-L frames may be prevented from being output for the 1 second, and the original image data of the L frames may be generated by decoding the compressed image bitstream of the L frames for the 1 second.

As described above, in a display device and a method of operating the display device according to some example embodiments, a still image detector may detect a still image by comparing a compressed image bitstream of a current frame and the compressed image bitstream of a previous frame, and a decoder may decode the compressed image bitstream at an output frame frequency lower than an input frame frequency when the still image is detected. Accordingly, power consumption of the display device may be reduced.

Further, in a display device and a method of operating the display device according to some example embodiments, a variable frequency decoder may detect a still image by comparing at least one of a plurality of substream data of a current frame and at least one of the plurality of substream data of a previous frame, and may decode the plurality of substream data at an output frame frequency lower than an input frame frequency when the still image is detected. Accordingly, power consumption of the display device may be reduced.

BRIEF DESCRIPTION OF THE DRAWINGS

Illustrative, non-limiting example embodiments will be more clearly understood from the following detailed description in conjunction with the accompanying drawings.

DETAILED DESCRIPTION

Hereinafter, example embodiments of the present inventive concept will be explained in more detail with reference to the accompanying drawings.

Figure 1:
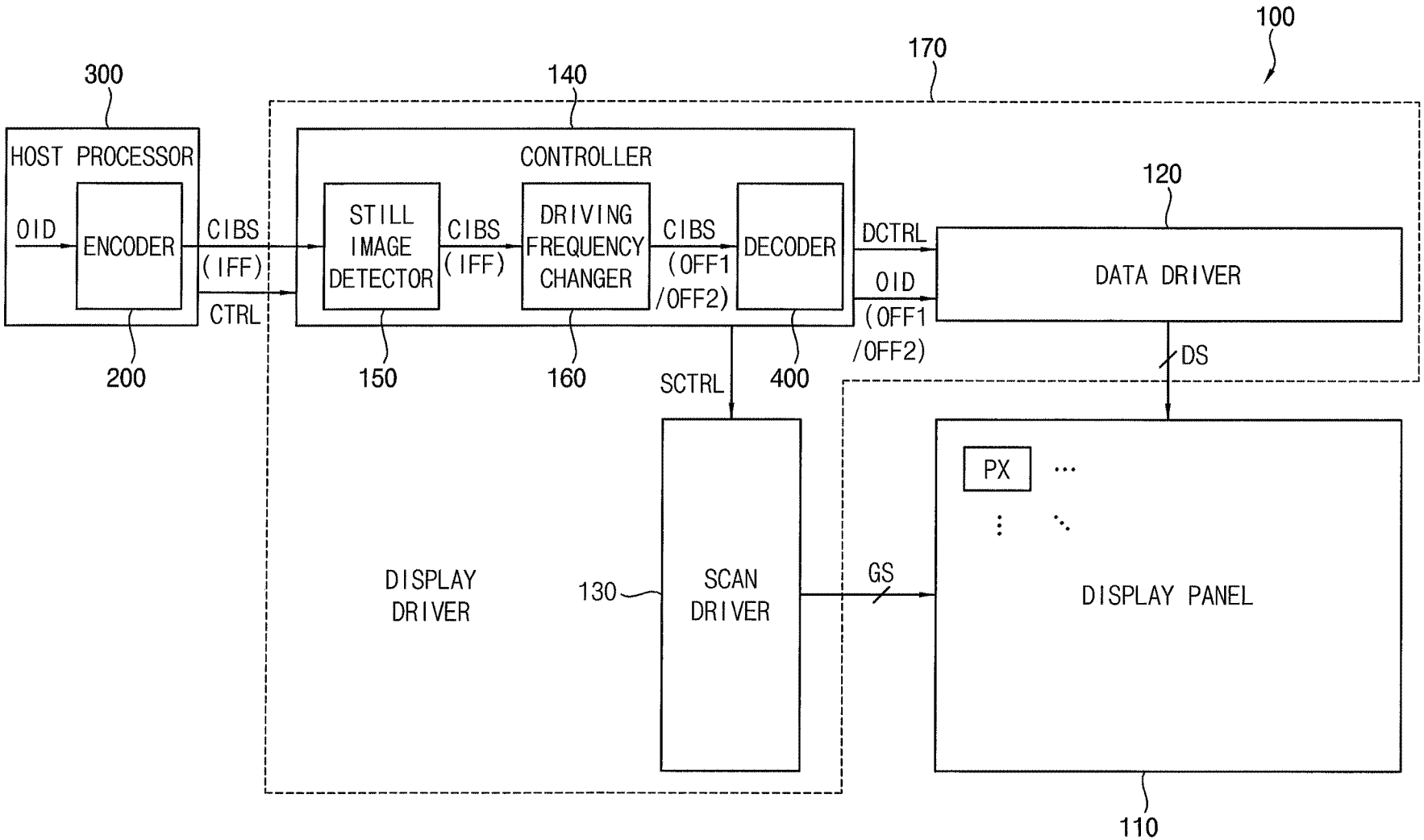
FIG. 1 is a block diagram illustrating a display device according to some example embodiments.
Figure 2:
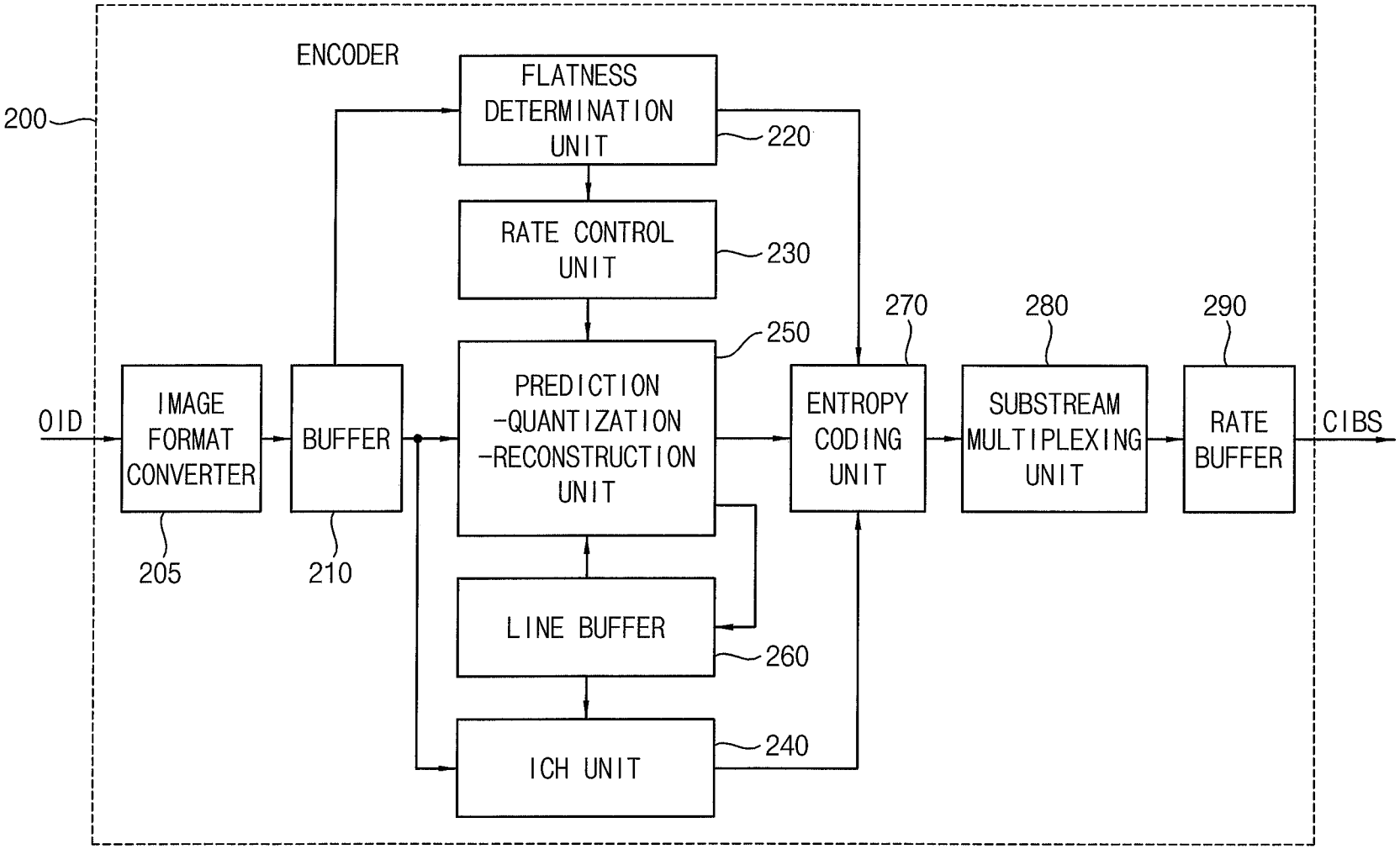
FIG. 2 is a block diagram illustrating an example of an encoder included in a host processor according to some example embodiments.
Figure 3:
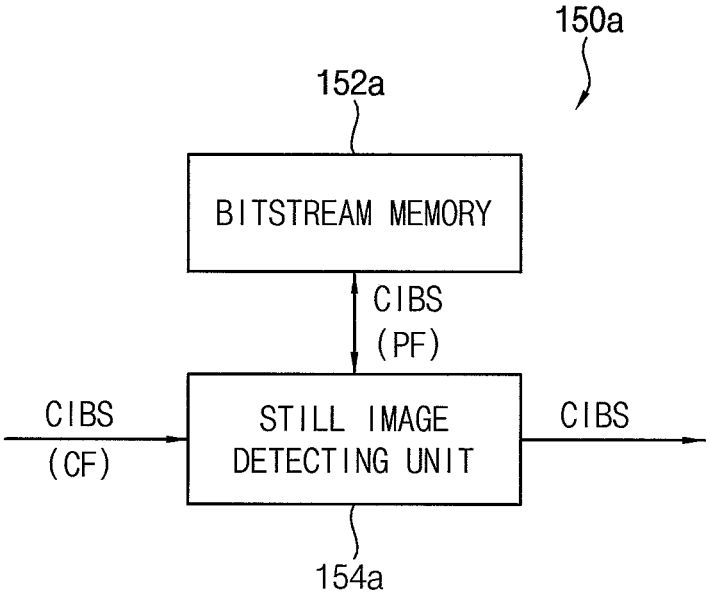
FIG. 3 is a block diagram illustrating an example of a still image detector included in a display device of FIG. 1.
Figure 4:
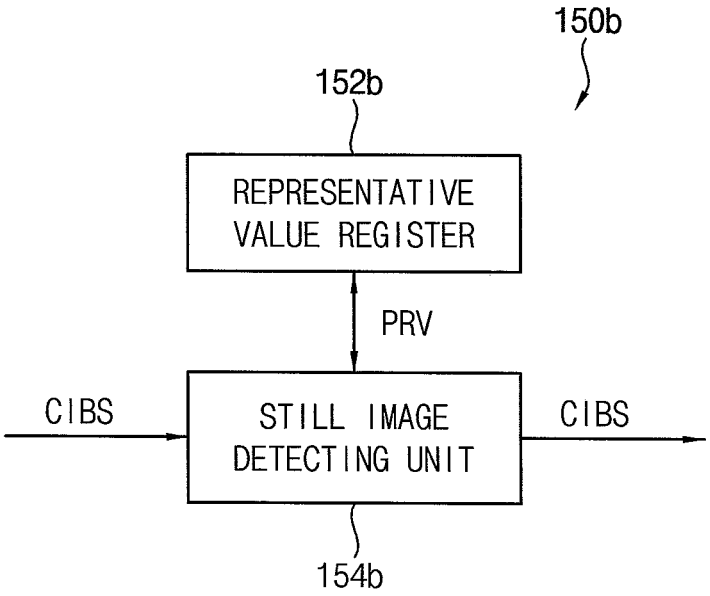
FIG. 4 is a block diagram illustrating an example of a still image detector included in a display device of FIG. 1.
Figure 5:
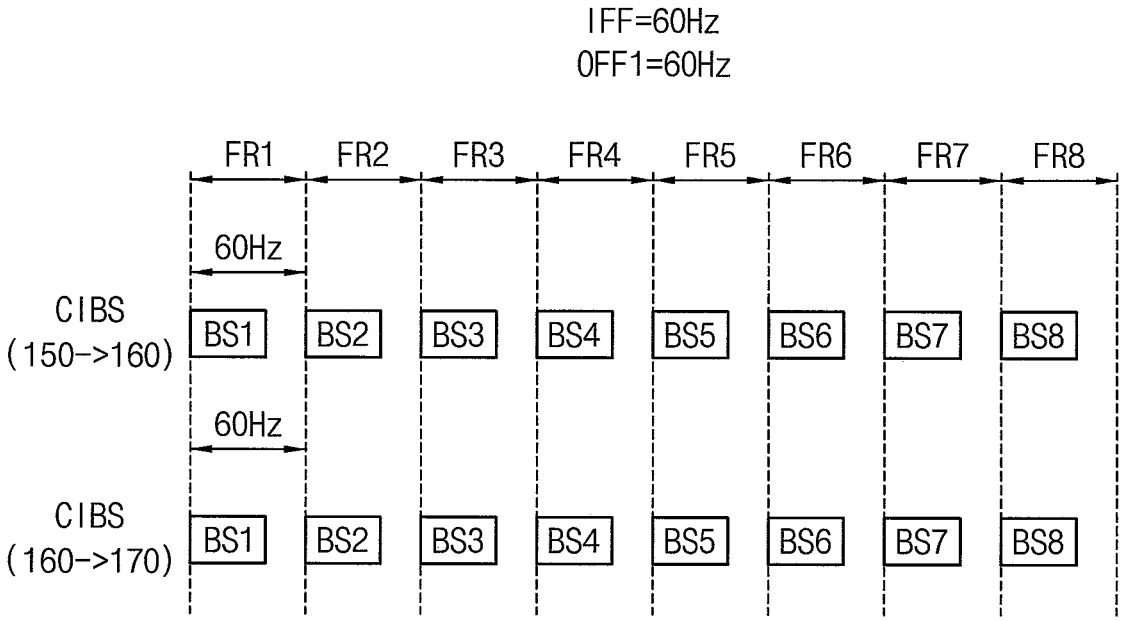
FIG. 5 is a diagram for describing an example of an operation of a driving frequency changer included in a display device of FIG. 1 when a still image is not detected.
Figure 6:
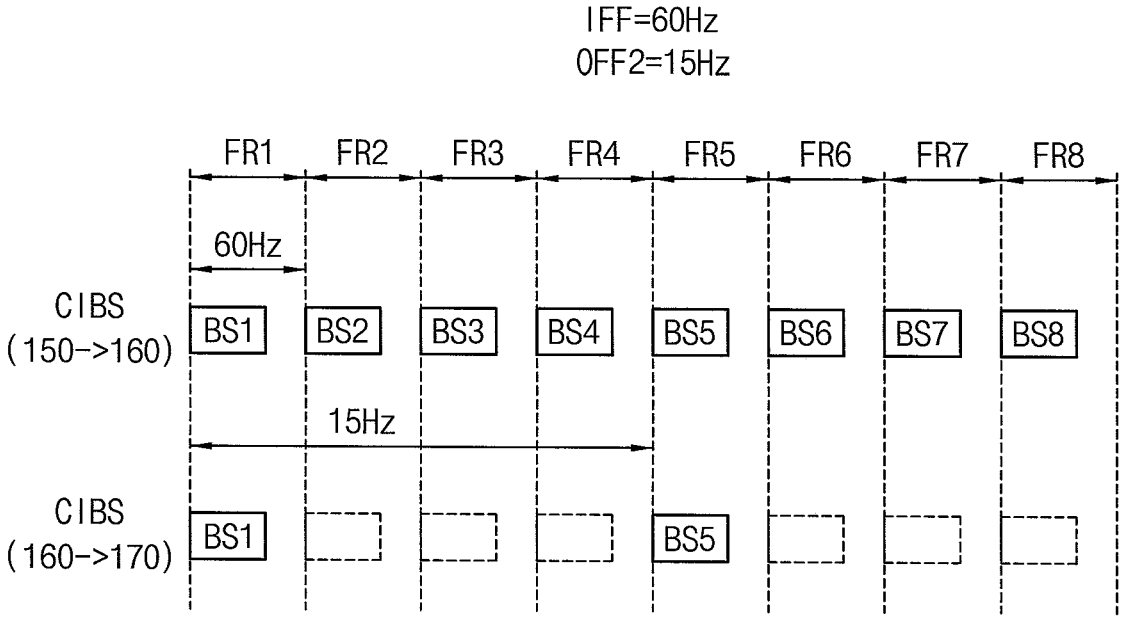
FIG. 6 is a diagram for describing an example of an operation of a driving frequency changer included in a display device of FIG. 1 when a still image is detected.
Figure 7:
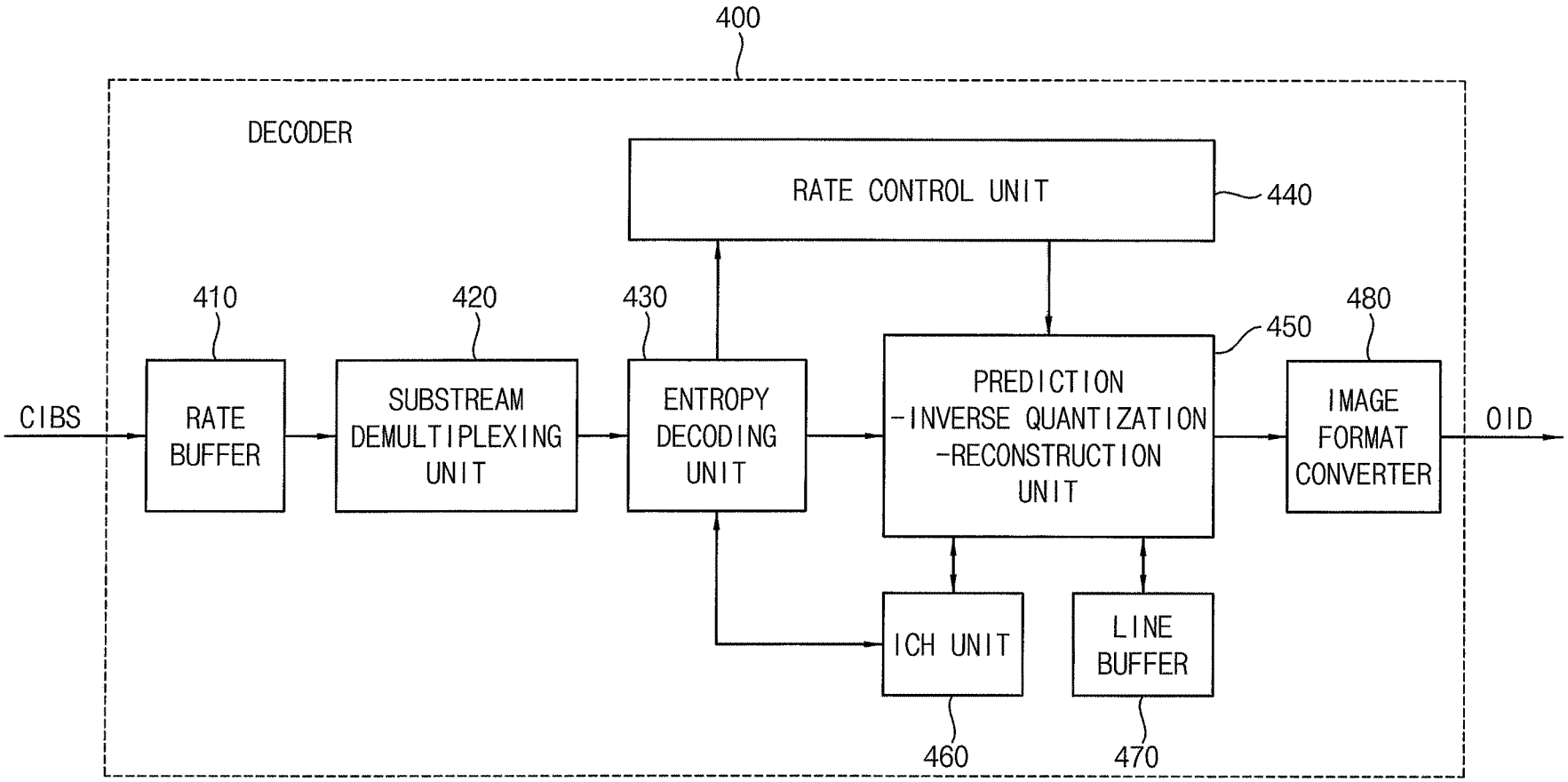
FIG. 7 is a block diagram illustrating an example of a decoder included in a display device of FIG. 1.

FIG. 1 is a block diagram illustrating a display device according to some example embodiments, FIG. 2 is a block diagram illustrating an example of an encoder included in a host processor, FIG. 3 is a block diagram illustrating an example of a still image detector included in a display device of FIG. 1, FIG. 4 is a block diagram illustrating another example of a still image detector included in a display device of FIG. 1, FIG. 5 is a diagram for describing an example of an operation of a driving frequency changer included in a display device of FIG. 1 when a still image is not detected, FIG. 6 is a diagram for describing an example of an operation of a driving frequency changer included in a display device of FIG. 1 when a still image is detected, and FIG. 7 is a block diagram illustrating an example of a decoder included in a display device of FIG. 1.

Referring to FIG. 1, a display device 100 according to some example embodiments may include a display panel 110 that includes a plurality of pixels PX, and a display driver 170 that drives the display panel 110. Although FIG. 1 illustrates a single pixel PX, a person having ordinary skill in the art would understand and appreciate that the display device 100 may include any suitable number of pixels PX according to the design of the display panel 110. In some example embodiments, the display driver 170 may include a data driver 120 that provides data signals DS to the plurality of pixels PX, a scan driver 130 that provides scan signals SS to the plurality of pixels PX, and a controller 140 that controls the data driver 120 and the scan driver 130.

The display panel 110 may include a plurality of data lines, a plurality of scan lines, and the plurality of pixels PX coupled to the plurality of data lines and the plurality of scan lines. According to some example embodiments, each pixel PX may include at least one capacitor, at least two transistors and an organic light emitting diode (OLED), and the display panel 110 may be an OLED display panel. Further, according to some example embodiments, each pixel PX may be a hybrid pixel suitable for low frequency driving for reducing power consumption. For example, in the hybrid pixel, a driving transistor may be implemented with a low-temperature polycrystalline silicon (LTPS) PMOS transistor, and a switching transistor may be implemented with an oxide NMOS transistor. According to some example embodiments, the display panel 110 may be a liquid crystal display (LCD) panel, or the like.

The data driver 120 may generate the data signals DS based on original image data OID and a data control signal DCTRL received from the controller 140, and may provide the data signals DS to the plurality of pixels PX through the plurality of data lines. According to some example embodiments, the data control signal DCTRL may include (but is not limited to including) an output data enable signal, a horizontal start signal and a load signal. According to some example embodiments, the data driver 120 and the controller 140 may be implemented with a single integrated circuit, and the integrated circuit may be referred to as a timing controller embedded data driver (TED). According to some example embodiments, the data driver 120 and the controller 140 may be implemented with separate integrated circuits.

The scan driver 130 may provide the scan signals SS to the plurality of pixels PX through the plurality of scan lines based on a scan control signal SCTRL received from the controller 140. According to some example embodiments, the scan driver 130 may sequentially provide the scan signals SS to the plurality of pixels PX on a row-by-row basis. Further, according to some example embodiments, the scan control signal SCTRL may include, but not be limited to, a scan start signal and a scan clock signal. According to some example embodiments, the scan driver 130 may be integrated or formed in a peripheral portion of the display panel 110. According to some example embodiments, the scan driver 130 may be implemented in the form of an integrated circuit.

The controller (e.g., a timing controller; TCON) 140 may receive a compressed image bitstream CIBS and a control signal CTRL from an external host processor (e.g., an application processor (AP), a graphic processing unit (GPU) or a graphic card) 300. According to some example embodiments, the control signal CTRL may include (but is not limited to including) a vertical synchronization signal, a horizontal synchronization signal, an input data enable signal, a master clock signal, etc. The controller 140 may generate the data control signal DCTRL, the scan control signal SCTRL and the original image data OID based on the compressed image bitstream CIBS and the control signal CTRL. The controller 140 may control an operation of the data driver 120 by providing the original image data OID and the data control signal to the data driver 120, and may control an operation of the scan driver 130 by providing the scan control signal SCTRL to the scan driver 130.

The host processor 300 may generate the compressed image bitstream CIBS by encoding the original image data OID, and the controller 140 may receive the compressed image bitstream CIBS at an input frame frequency IFF from the host processor 300. The host processor 300 may include an encoder 200 that encodes the original image data OID. According to some example embodiments, the encoder 200 may generate a display stream compression (DSC) bitstream as the compressed image bitstream CIBS by encoding the original image data OID according to a DSC standard of a video electronics standards association (VESA). However, an encoding method of the encoder 200 may not be limited to the DSC standard.

For example, as illustrated in FIG. 2, the encoder 200 may include an image format converter 205, a buffer 210, a flatness determination unit 220, a rate control unit 230, an index color history (ICH) unit 240, a prediction-quantization-reconstruction unit 250, a line buffer 260, an entropy coding unit 270, a substream multiplexing unit 280 and a rate buffer 290.

The image format converter 205 may convert a format of the original image data OID. According to some example embodiments, the image format converter 205 may convert the format of the original image data OID an RGB format to a format including a luminance component, a first chrominance component and a second chrominance component. According to some example embodiments, the first chrominance component may be an orange chrominance component, the second chrominance component may be a green chrominance component, and the image format converter 205 may convert the RGB format to an YCoCg format. According to some example embodiments, the first chrominance component may be a blue chrominance component, the second chrominance component may be a red chrominance component, and the image format converter 205 may convert the RGB format to an YCbCr format.

The buffer 210 may temporarily store the original image data OID of which the format is converted by the image format converter 205. The flatness determination unit 220 may perform a flatness check operation on the original image data OID stored in the buffer 210. According to some example embodiments, the flatness determination unit 220 may determine whether a quantization operation is moved from a region including pixels PX with relatively rough/choppy pixel values to a region including pixels PX with relatively smooth pixel values. Here, the pixel values may represent, but are not limited to representing, values of the original image data OID for pixels PX included in the display device 100. The flatness determination unit 220 and/or the rate control unit 230 may adjust a quantization parameter based on the result of determination in the flatness determination unit 220. The flatness determination unit 220 may provide flatness information generated by the flatness check operation to the rate control unit 230 to adjust the quantization parameter, and may provide the flatness information to the entropy coding unit 270 such that the flatness information is included in the compressed image bitstream CIBS.

The rate control unit 230 may determine the quantization parameter and control a bit rate based on at least one of a status of the rate buffer 290, the number of bits used for a current prediction, or the result of determination in the flatness determination unit 220.

The ICH unit 240 may determine, with respect to each pixel group, whether to perform predictive coding by the prediction-quantization-reconstruction unit 250 or to perform ICH coding by the ICH unit 240. Whether the predictive coding or the ICH coding is performed may be determined per pixel group. For example, each pixel group may include three consecutive pixels PX. In situations in which it is determined that the ICH coding is to be performed, the ICH unit 240 may perform the ICH coding for the pixel group. To perform the ICH coding, the ICH unit 240 may store pixel values recently encoded by the predictive coding, and may generate ICH index data representing indexes that indicate pixel values corresponding to a current pixel group among the stored pixel values. Thus, the ICH unit 240 may not perform prediction, quantization, etc. for the current pixel group, and may refer to previously encoded pixel values.

The prediction-quantization-reconstruction unit 250 may generate prediction values for the pixel group, and may perform the predictive coding by quantizing residual values calculated by subtracting the prediction values from values of the original image data OID based on the quantization parameter. According to some example embodiments, the prediction-quantization-reconstruction unit 250 may derive/determine the prediction values using one or more of an MMAP (Modified Median-Adaptive Prediction) mode, a BP (Block Prediction) mode and an MPP (Midpoint Prediction) mode. Further, the prediction-quantization-reconstruction unit 250 may generate reconstructed values for the pixel group by inverse quantizing the quantized residual values and by adding the results of the inverse quantization to the prediction values, and may store the reconstructed values in the line buffer 260. The line buffer 260 may store the reconstructed values for a previous line, and the prediction-quantization-reconstruction unit 250 may derive/determine the prediction values for the current pixel group by using the reconstructed values for the previous line stored in the line buffer 260.

The entropy coding unit 270 may generate a plurality of substream data for the luminance component, the first chrominance component and the second chrominance component of the original image data OID by performing entropy encoding on at least one of the quantized residual values, the ICH index data generated by the ICH coding or the flatness information generated by the flatness determination unit 220. For example, the entropy coding unit 270 may perform variable-length coding on the quantized residual values.

The substream multiplexing unit 280 may generate the compressed image bitstream CIBS by multiplexing the plurality of substream data from the entropy coding unit 270. The rate buffer 290 may temporarily store the compressed image bitstream CIBS to prevent bitstream loss during transmission.

Although FIG. 2 illustrates an example of a configuration of the encoder 200, the configuration of the encoder 200 according to some example embodiments may not be limited to the example of FIG. 2.

The controller 140 may receive the compressed image bitstream CIBS encoded by the encoder 200 at the input frame frequency IFF from the host processor 300, and may generate the original image data OID by decoding the compressed image bitstream CIBS at a first output frame frequency OFF1 substantially the same as the input frame frequency IFF or at a second output frame frequency OFF2 lower than the input frame frequency IFF according to whether the compressed image bitstream CIBS represents a still image. To perform these operations, the controller 140 may include a still image detector 150, a driving frequency changer 160 and a decoder 400.

The still image detector 150 may be located in the front of the decoder 400, and may receive the compressed image bitstream CIBS at the input frame frequency IFF from the host processor 300. The still image detector 150 may detect the still image based on the compressed image bitstream CIBS. In some example embodiments, the still image detector 150 may detect the still image by comparing the compressed image bitstream CIBS of a current frame and the compressed image bitstream CIBS of a previous frame.

According to some example embodiments, the still image detector 150 may store the compressed image bitstream CIBS of the previous frame, and may detect the still image by comparing the compressed image bitstream CIBS of the current frame and the stored compressed image bitstream CIBS of the previous frame. For example, as illustrated in FIG. 3, the still image detector 150*a* may include a bitstream memory 152*a* that stores the compressed image bitstream CIBS of the previous frame, and a still image detecting unit 154*a* that compares the compressed image bitstream CIBS of the current frame CF received from the host processor 300 and the compressed image bitstream CIBS of the previous frame PF stored in the bitstream memory 152*a*. The still image detecting unit 154*a* may determine that the still image is not detected (e.g., that the compressed image bitstream CIBS represents a moving image) when the compressed image bitstream CIBS of the current frame CF is different from the compressed image bitstream CIBS of the previous frame PF, and may determine that the still image is detected (e.g., that the compressed image bitstream CIBS represents the still image) when the compressed image bitstream CIBS of the current frame CF is substantially the same as the compressed image bitstream CIBS of the previous frame PF. After determining whether the still image is detected or not, the still image detecting unit 154*a* may store the compressed image bitstream CIBS of the current frame CF in the bitstream memory 152*a* to be used in the still image detection for the next frame.

According to some example embodiments, the still image detector 150 may store a previous representative value of the compressed image bitstream CIBS of the previous frame, may calculate a current representative value of the compressed image bitstream CIBS of the current frame, and may detect the still image by comparing the current representative value and the previous representative value. According to some example embodiments, each of the previous and current representative values may be an average value of the compressed image bitstream CIBS, a checksum of the compressed image bitstream CIBS, or any value extracted from the compressed image bitstream CIBS. For example, as illustrated in FIG. 4, the still image detector 150*b* may include a representative value register 152*b* that stores the previous representative value PRV of the compressed image bitstream CIBS of the previous frame, and a still image detecting unit 154*b* that calculates the current representative value of the compressed image bitstream CIBS of the current frame received from the host processor 300, and compares the current representative value and the previous representative value PRV stored in the representative value register 152*b*. The still image detecting unit 154*b* may determine that the still image is not detected when the current representative value is different from the previous representative value PRV, and may determine that the still image is detected when the current representative value is substantially the same as the previous representative value PRV. After determining whether the still image is detected or not, the still image detecting unit 154*b* may store the current representative value in the representative value register 152*b* to be used in the still image detection for the next frame.

The driving frequency changer 160 may output the compressed image bitstream CIBS at the first output frame frequency OFF1 substantially the same as the input frame frequency IFF when the still image is not detected, and may output the compressed image bitstream CIBS at the second output frame frequency OFF2 lower than the input frame frequency IFF when the still image is detected.

According to some example embodiments, in situations in which the still image is not detected, while the compressed image bitstream CIBS of N frames is input, the driving frequency changer 160 may output the compressed image bitstream CIBS of the N frames intactly, where N is an integer greater than 1. That is, in situations in which the still image is not detected and the input frame frequency IFF is K Hz, where K is an integer greater than 1, the driving frequency changer 160 may receive the compressed image bitstream CIBS of K frames for 1 second, and may output the compressed image bitstream CIBS of the K frames for the 1 second. For example, as illustrated in FIG. 5, in situations in which the still image is not detected and the driving frequency changer 160 receives first through eighth bitstreams BS1 through BS8 during first through eighth frames FR1 through FR8, the driving frequency changer 160 may output the first through eighth bitstreams BS1 through BS8 intactly during the first through eighth frames FR1 through FR8. Accordingly, in situations in which the compressed image bitstream CIBS is received at the input frame frequency IFF of about 60 Hz from the host processor 300, the driving frequency changer 160 may output the compressed image bitstream CIBS at the first output frame frequency OFF1 of about 60 Hz to the decoder 400.

Further, in situations in which the still image is detected, while the compressed image bitstream CIBS of the N frames is input, the driving frequency changer 160 may output the compressed image bitstream CIBS of M frames, where M is an integer greater than 0 and less than N. That is, in situations in which the still image is detected, the input frame frequency IFF is K Hz, and the second output frame frequency OFF2 is L Hz, where L is an integer greater than 0 and less than K, the driving frequency changer 160 may receive the compressed image bitstream CIBS of K frames for 1 second, may output the compressed image bitstream CIBS of L frames for the 1 second, and may not output the compressed image bitstream CIBS of K-L frames for the 1 second. For example, as illustrated in FIG. 6, in situations in which the still image is detected and the driving frequency changer 160 receives first through eighth bitstreams BS1 through BS8 during first through eighth frames FR1 through FR8, the driving frequency changer 160 may output the first bitstream BS1 during the first through fourth frames FR1 through FR4, and may not output the second through fourth bitstreams BS2 through BS4 during the first through fourth frames FR1 through FR4. Further, the driving frequency changer 160 may output the fifth bitstream BS5 during the fifth through eighth frames FR5 through FR8, and may not output the sixth through eighth bitstreams BS6 through BS8 during the fifth through eighth frames FR5 through FR8. Accordingly, in situations in which the compressed image bitstream CIBS is received at the input frame frequency IFF of about 60 Hz from the host processor 300, the driving frequency changer 160 may output the compressed image bitstream CIBS at the second output frame frequency OFF2 of about 15 Hz to the decoder 400.

In situations in which the still image is not detected, the decoder 400 may receive the compressed image bitstream CIBS at the first output frame frequency OFF1 from the driving frequency changer 160, may generate the original image data OID at the first output frame frequency OFF1 by decoding the compressed image bitstream CIBS at the first output frame frequency OFF1, and may provide the original image data OID to the data driver 120 at the first output frame frequency OFF1. Further, in situations in which the still image is detected, the decoder 400 may receive the compressed image bitstream CIBS at the second output frame frequency OFF2 from the driving frequency changer 160, may generate the original image data OID at the second output frame frequency OFF2 by decoding the compressed image bitstream CIBS at the second output frame frequency OFF2, and may provide the original image data OID to the data driver 120 at the second output frame frequency OFF2. Accordingly, while the still image is displayed in the display device 100 according to some example embodiments, the decoder 400 may perform the decoding at the second output frame frequency OFF2 lower than the input frame frequency IFF, the display panel 110 may be driven or refreshed at the second output frame frequency OFF2 lower than the input frame frequency IFF, and thus the power consumption of the display device 100 may be reduced.

According to some example embodiments, the decoder 400 may be, but not limited to, a DSC decoder that decodes the compressed image bitstream CIBS according to the DSC standard of the VESA. Thus, the decoder 400 may perform the decoding corresponding to the encoding performed by the encoder 200 of FIG. 2. For example, as illustrated in FIG. 7, the decoder 400 may include a rate buffer 410 that temporarily stores the compressed image bitstream CIBS, a substream demultiplexing unit 420 that generates a plurality of substream data for a luminance component, a first chrominance component and a second chrominance component by demultiplexing the compressed image bitstream CIBS, an entropy decoding unit 430 that generates at least one of residual values, indexed color history (ICH) index data, or flatness information by performing entropy decoding on the plurality of substream data, a rate control unit 440 that determines a quantization parameter based on at least one of the number of bits used in a current prediction or the flatness information, a prediction-inverse quantization-reconstruction unit 450 that generates prediction values for a pixel group, inverse quantizes the residual values from the entropy decoding unit 430 based on the quantization parameter, and generates pixel values for the pixel group by adding the inverse quantized residual values to the prediction values, an ICH unit 460 that performs ICH decoding for the pixel group based on the ICH index data from the entropy decoding unit 430, a line buffer 470 that stores the pixel values for a previous line, and an image format converter 480 that generates the original image data OID by converting a format of the pixel values output from the prediction-inverse quantization-reconstruction unit 450. For example, the image format converter 480 may convert an YCoCg format to an RGB format, or may convert an YCbCr format to an RGB format.

As described above, in the display device 100 according to some example embodiments, the still image detector 150 may detect the still image by comparing the compressed image bitstream CIBS of the current frame and the compressed image bitstream CIBS of the previous frame, and the decoder 400 may decode the compressed image bitstream CIBS at the second output frame frequency OFF2 lower than the input frame frequency IFF when the still image is detected. Accordingly, the power consumption of the display device 100 according to some example embodiments may be reduced.

Figure 8:
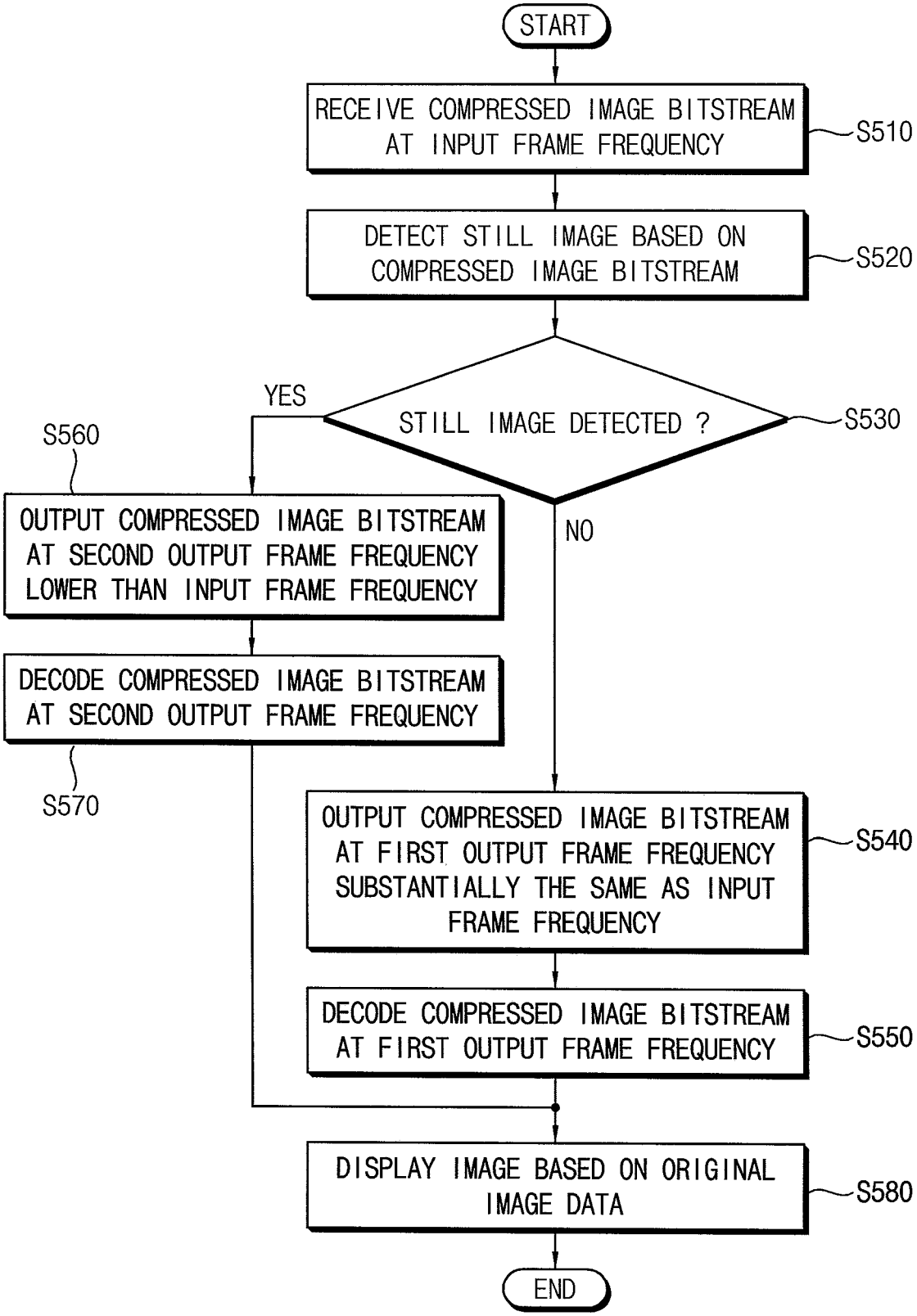
FIG. 8 is a flowchart illustrating a method of operating a display device according to some example embodiments.

FIG. 8 is a flowchart illustrating a method of operating a display device according to some example embodiments.

Referring to FIGS. 1 and 8, a still image detector 150 of a display device 100 may receive a compressed image bitstream CIBS at an input frame frequency IFF from a host processor 300 (S510), and may detect a still image based on the compressed image bitstream CIBS (S520).

According to some example embodiments, the still image detector 150 may store the compressed image bitstream CIBS of a previous frame in a bitstream memory, may compare the compressed image bitstream CIBS of a current frame received from the host processor 300 and the compressed image bitstream CIBS of the previous frame stored in the bitstream memory, may determine that the still image is not detected when the compressed image bitstream CIBS of the current frame is different from the compressed image bitstream CIBS of the previous frame, and may determine that the still image is detected when the compressed image bitstream CIBS of the current frame is substantially the same as the compressed image bitstream CIBS of the previous frame.

According to some example embodiments, the still image detector 150 may store a previous representative value of the compressed image bitstream CIBS of the previous frame in a representative value register, may calculate a current representative value of the compressed image bitstream CIBS of the current frame received from the host processor 300, may compare the current representative value and the previous representative value stored in the representative value register, may determine that the still image is not detected when the current representative value is different from the previous representative value, and may determine that the still image is detected when the current representative value is substantially the same as the previous representative value.

When the still image is not detected (S530: NO), a driving frequency changer 160 may output the compressed image bitstream CIBS at a first output frame frequency OFF1 substantially the same as the input frame frequency IFF (S540), and a decoder 400 may generate original image data OID at the first output frame frequency OFF1 by decoding the compressed image bitstream CIBS at the first output frame frequency OFF1 (S550). Thus, a controller 140 may provide the original image data OID to a data driver 120 at the first output frame frequency OFF1, and the data driver 120 may drive a display panel 110 at the first output frame frequency OFF1 substantially the same as the input frame frequency IFF based on the original image data OID to display an image (S580).

When the still image is detected (S530: YES), the driving frequency changer 160 may output the compressed image bitstream CIBS at a second output frame frequency OFF2 lower than the input frame frequency IFF (S560), and the decoder 400 may generate the original image data OID at the second output frame frequency OFF2 by decoding the compressed image bitstream CIBS at the second output frame frequency OFF2 (S570). According to some example embodiments, in situations in which the still image is detected, and the compressed image bitstream CIBS of N frames is received for a first time, where N is an integer greater than 1, the driving frequency changer 160 may output the compressed image bitstream CIBS of M frames for the first time, where M is an integer greater than 0 and less than N, and the decoder 400 may generate the original image data OID of the M frames by decoding the compressed image bitstream CIBS of the M frames for the first time. For example, in situations in which the still image is detected, the input frame frequency IFF is K Hz, and the second output frame frequency OFF2 is L Hz, where K is an integer greater than 1, and L is an integer greater than 0 and less than K, the driving frequency changer 160 may output the compressed image bitstream CIBS of L frames for 1 second, and may prevent the compressed image bitstream CIBS of K-L frames from being output for the 1 second, and the decoder 400 may generate the original image data OID of the L frames by decoding the compressed image bitstream CIBS of the L frames for the 1 second. Thus, the controller 140 may provide the original image data OID to the data driver 120 at the second output frame frequency OFF2, and the data driver 120 may drive the display panel 110 at the second output frame frequency OFF2 lower than the input frame frequency IFF based on the original image data OID to display an image (S580). Accordingly, while the still image is displayed in the display device 100 according to some example embodiments, the decoder 400 may perform the decoding on the compressed image bitstream CIBS at the second output frame frequency OFF2 lower than the input frame frequency IFF, and the display panel 100 may be driven or refreshed at the second output frame frequency OFF2 lower than the input frame frequency IFF, thereby reducing the power consumption of the display device 100.

Figure 9:
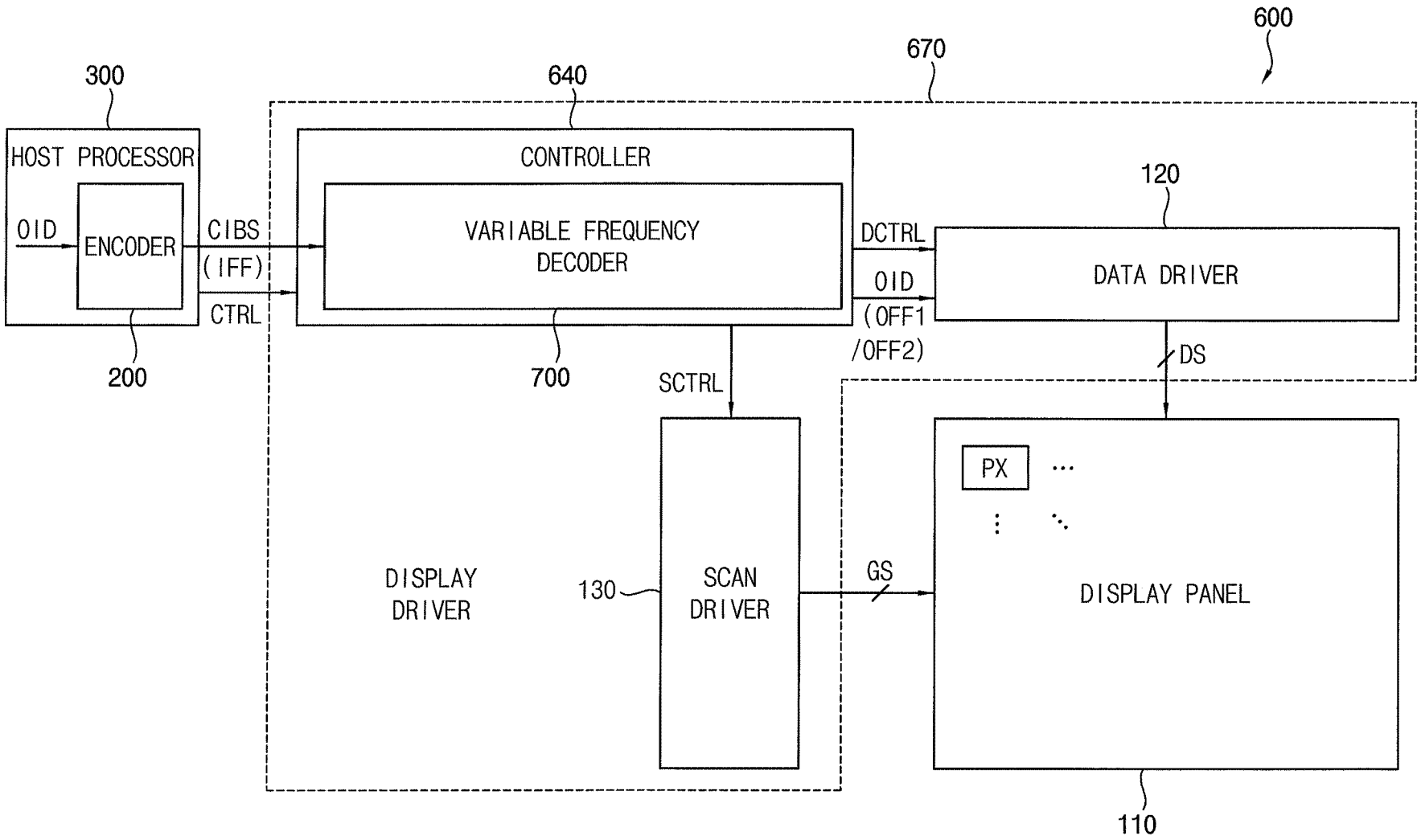
FIG. 9 is a block diagram illustrating a display device according to some example embodiments.
Figure 10:
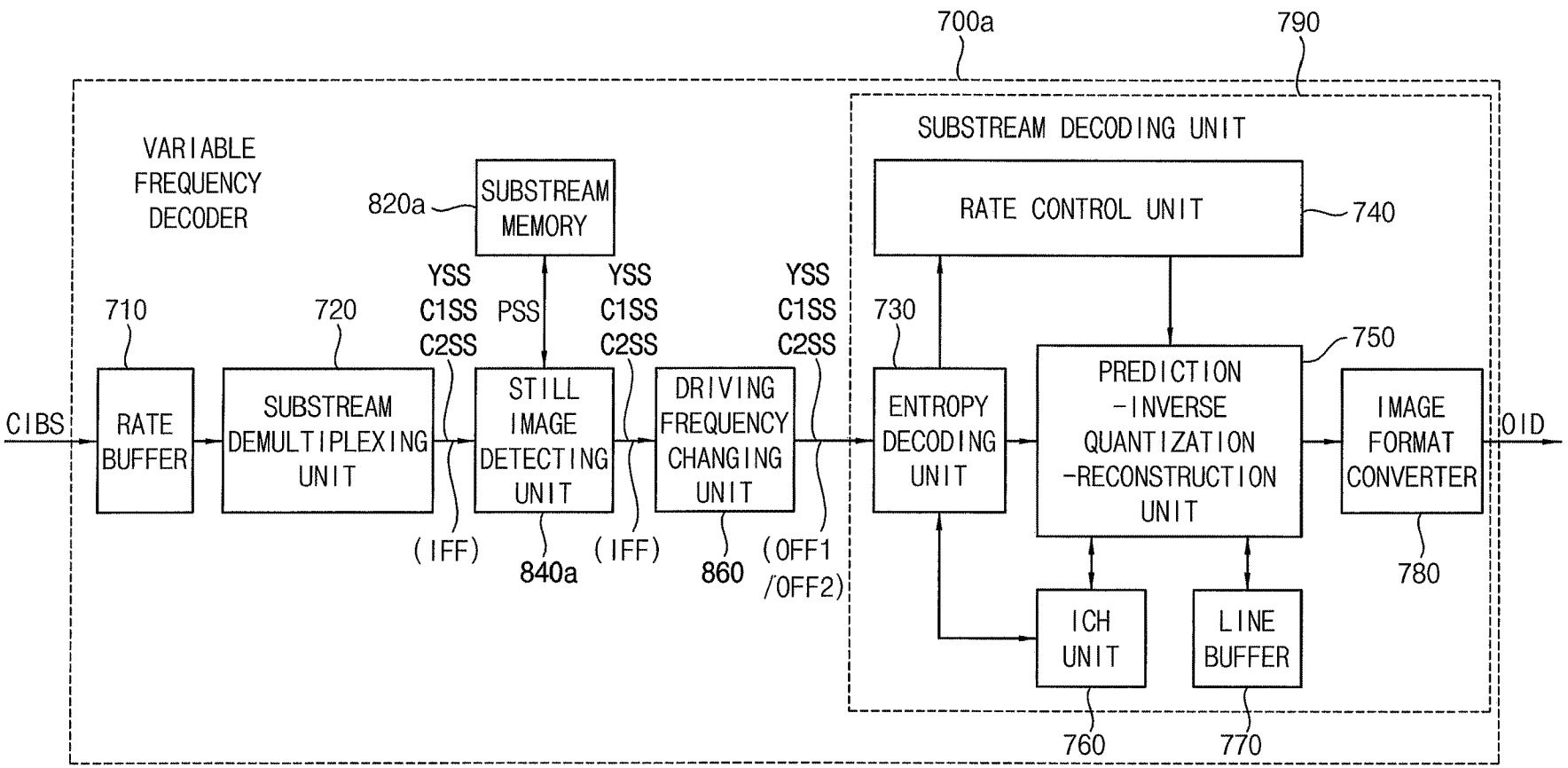
FIG. 10 is a block diagram illustrating an example of a variable frequency decoder included in a display device of FIG. 9.
Figure 11:
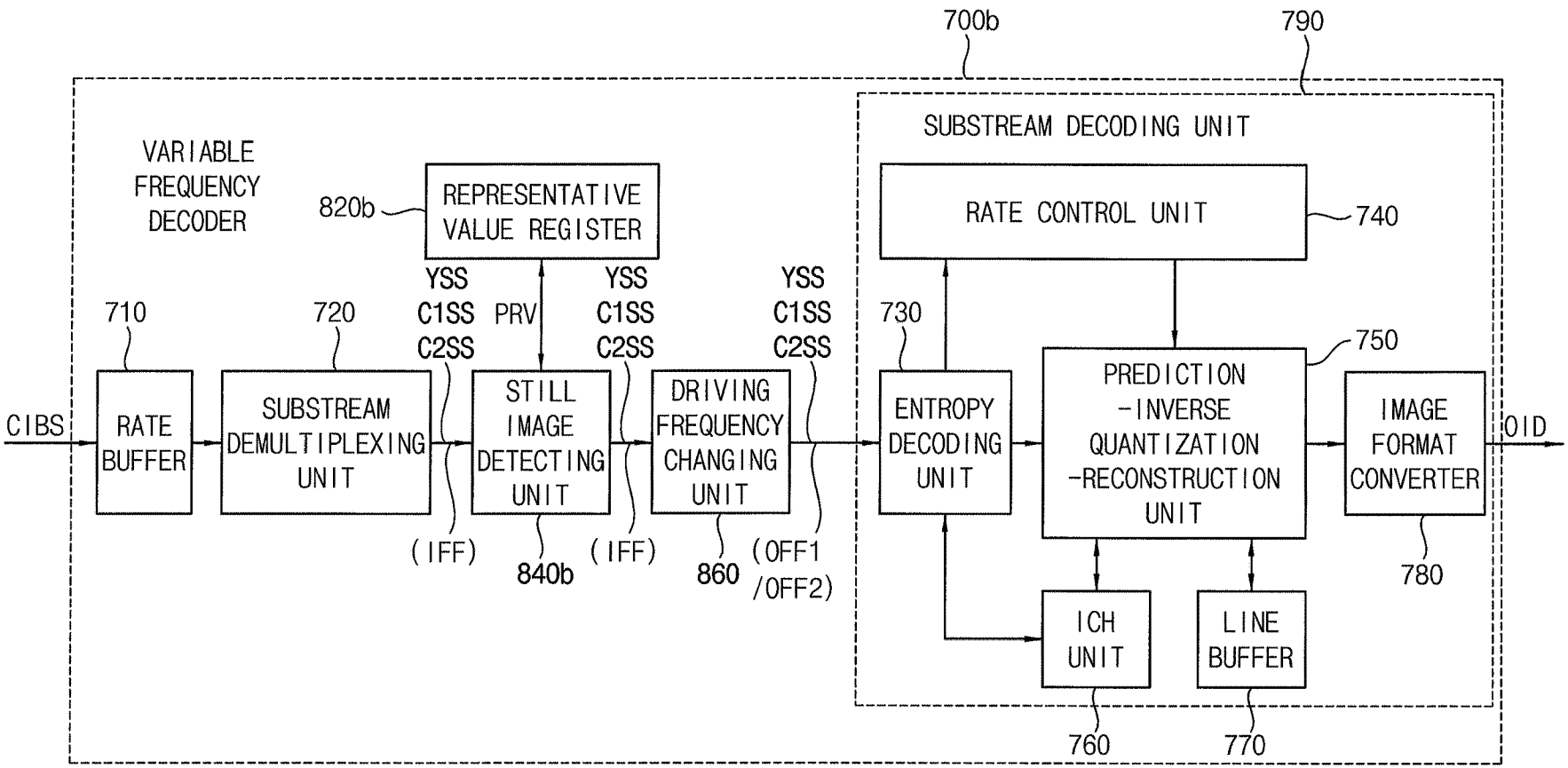
FIG. 11 is a block diagram illustrating another example of a variable frequency decoder included in a display device of FIG. 9.

FIG. 9 is a block diagram illustrating a display device according to some example embodiments, FIG. 10 is a block diagram illustrating an example of a variable frequency decoder included in a display device of FIG. 9, and FIG. 11 is a block diagram illustrating another example of a variable frequency decoder included in a display device of FIG. 9.

Referring to FIG. 9, a display device 600 according to some example embodiments may include a display panel 110 that includes a plurality of pixels PX, and a display driver 670 that drives the display panel 110. According to some example embodiments, the display driver 670 may include a data driver 120, a scan driver 130 and a controller 640. The display device 600 of FIG. 9 may have a similar configuration and a similar operation to a display device 100 of FIG. 1, except that the controller 640 includes a variable frequency decoder 700.

The variable frequency decoder 700 may receive a compressed image bitstream CIBS at an input frame frequency IFF from a host processor 300, may generate a plurality of substream data by demultiplexing the compressed image bitstream CIBS, and may detect a still image by comparing at least one of the plurality of substream data of a current frame and at least one of the plurality of substream data of a previous frame. Further, the variable frequency decoder 700 may generate original image data OID at a first output frame frequency OFF1 substantially the same as the input frame frequency IFF by decoding the plurality of substream data at the first output frame frequency OFF1 when the still image is not detected, and may generate the original image data OID at a second output frame frequency OFF2 lower than the input frame frequency IFF by decoding the plurality of substream data at the second output frame frequency OFF2 when the still image is detected.

According to some example embodiments, as illustrated in FIG. 10, the variable frequency decoder 700*a* may include a substream demultiplexing unit 720, a substream memory 820*a*, a still image detecting unit 840*a*, a driving frequency changing unit 860 and a substream decoding unit 790. The variable frequency decoder 700*a* may further include a rate buffer 710 that temporarily stores the compressed image bitstream CIBS received from the host processor 300, and outputs the temporarily stored compressed image bitstream CIBS to the substream demultiplexing unit 720.

The substream demultiplexing unit 720 may generate the plurality of substream data YSS, C1SS and C2SS for a luminance component, a first chrominance component and a second chrominance component by demultiplexing the compressed image bitstream CIBS. For example, the substream demultiplexing unit 720 may generate the substream data YSS for the luminance component, the substream data C1SS for an orange chrominance component and the substream data C2SS for a green chrominance component by demultiplexing the compressed image bitstream CIBS.

The substream memory 820*a* may store at least one of the plurality of substream data YSS, C1SS or C2SS of the previous frame. For example, the substream memory 820*a* may store one, two or all of the substream data YSS for the luminance component, the substream data C1SS for an orange chrominance component and the substream data C2SS for a green chrominance component.

The still image detecting unit 840*a* may compare at least one of the plurality of substream data YSS, C1SS or C2SS of the current frame received from the substream demultiplexing unit 720 and at least one of the plurality of substream data YSS, C1SS or C2SS of the previous frame stored in the substream memory 820*a*. In an example, the substream data YSS for the luminance component of the previous frame may be stored in the substream memory 820*a*, and the still image detecting unit 840*a* may compare the substream data YSS for the luminance component of the current frame received from the substream demultiplexing unit 720 and the substream data YSS for the luminance component of the previous frame stored in the substream memory 820*a*. In another example, the three substream data YSS, C1SS and C2SS of the previous frame may be stored in the substream memory 820*a*, and the still image detecting unit 840*a* may compare the three substream data YSS, C1SS and C2SS of the current frame received from the substream demultiplexing unit 720 and the three substream data YSS, C1SS and C2SS of the previous frame stored in the substream memory 820*a*.

The still image detecting unit 840*a* may determine that the still image is not detected when the at least one of the plurality of substream data YSS, C1SS or C2SS of the current frame is different from the at least one of the plurality of substream data YSS, C1SS or C2SS of the previous frame, and may determine that the still image is detected when the at least one of the plurality of substream data YSS, C1SS or C2SS of the current frame is substantially the same as the at least one of the plurality of substream data YSS, C1SS or C2SS of the previous frame.

The driving frequency changing unit 860 may output the plurality of substream data YSS, C1SS and C2SS at the first output frame frequency OFF1 substantially the same as the input frame frequency IFF when the still image is not detected, and may output the plurality of substream data YSS, C1SS and C2SS at the second output frame frequency OFF2 lower than the input frame frequency IFF when the still image is detected. According to some example embodiments, while the plurality of substream data YSS, C1SS and C2SS of N frames is input, where N is an integer greater than 1, the driving frequency changing unit 860 may output the plurality of substream data YSS, C1SS and C2SS of the N frames when the still image is not detected, and may output the plurality of substream data YSS, C1SS and C2SS of M frames when the still image is detected, where M is an integer greater than 0 and less than N. For example, in situations in which the input frame frequency IFF is K Hz, and the second output frame frequency OFF2 is L Hz, where K is an integer greater than 1, and L is an integer greater than 0 and less than K, the driving frequency changing unit 860 may output the plurality of substream data YSS, C1SS and C2SS of K frames for 1 second when the still image is not detected. Further, when the still image is detected, the driving frequency changing unit 860 may output the plurality of substream data YSS, C1SS and C2SS of L frames for 1 second, and may not output the plurality of substream data YSS, C1SS and C2SS of K-L frames for the 1 second.

The substream decoding unit 790 may generate the original image data OID at the first output frame frequency OFF1 by decoding the plurality of substream data YSS, C1SS and C2SS at the first output frame frequency OFF1 when the still image is not detected, and may generate the original image data OID at the second output frame frequency OFF2 by decoding the plurality of substream data YSS, C1SS and C2SS at the second output frame frequency OFF2 when the still image is detected. For example, as illustrated in FIG. 10, the substream decoding unit 790 may include an entropy decoding unit 730 that generates at least one of residual values, indexed color history (ICH) index data or flatness information by performing entropy decoding on the plurality of substream data YSS, C1SS and C2SS, a rate control unit 740 that determines a quantization parameter based on at least one of the number of bits used in a current prediction or the flatness information, a prediction-inverse quantization-reconstruction unit 750 that generates prediction values for a pixel group, inverse quantizes the residual values from the entropy decoding unit 730 based on the quantization parameter, and generates pixel values for the pixel group by adding the inverse quantized residual values to the prediction values, an ICH unit 760 that performs ICH decoding for the pixel group based on the ICH index data from the entropy decoding unit 730, a line buffer 770 that stores the pixel values for a previous line, and an image format converter 780 that generates the original image data OID by converting a format of the pixel values output from the prediction-inverse quantization-reconstruction unit 750.

According to some example embodiments, as illustrated in FIG. 11, the variable frequency decoder 700*b* may include a substream demultiplexing unit 720, a representative value register 820*b*, a still image detecting unit 840*b*, a driving frequency changing unit 860, and the substream decoding unit 790. The variable frequency decoder 700*b* may further include the rate buffer 710. The variable frequency decoder 700*b* of FIG. 11 may have a similar configuration and a similar operation to the variable frequency decoder 700*a* of FIG. 10, except that the variable frequency decoder 700*b* may include the representative value register 820*b* instead of the substream memory 820*a*, and that the still image detecting unit 840*b* may detect the still image by comparing a current representative value and a previous representative value.

The representative value register 820*b* may store the previous representative value PRV of at least one of the plurality of substream data YSS, C1SS or C2SS of the previous frame. For example, the representative value register 820*b* may store one, two or all of the representative value of the substream data YSS for the luminance component (e.g., an average value, a checksum or any value extracted from the substream data YSS for the luminance component), the representative value of the substream data C1SS for the orange chrominance component, and the representative value of the substream data C2SS for the green chrominance component.

The still image detecting unit 840*b* may calculate the current representative value of at least one of the plurality of substream data YSS, C1SS or C2SS of the current frame received from the substream demultiplexing unit 720, may compare the current representative value and the previous representative value stored in the representative value register 820*b*, may determine that the still image is not detected when the current representative value is different from the previous representative value PRV, and may determine that the still image is detected when the current representative value is substantially the same as the previous representative value PRV.

The driving frequency changing unit 860 may output the plurality of substream data YSS, C1SS and C2SS at the first output frame frequency OFF1 when the still image is not detected, and may output the plurality of substream data YSS, C1SS and C2SS at the second output frame frequency OFF2 when the still image is detected. The substream decoding unit 790 may generate the original image data OID at the first output frame frequency OFF1 by decoding the plurality of substream data YSS, C1SS and C2SS at the first output frame frequency OFF1 when the still image is not detected, and may generate the original image data OID at the second output frame frequency OFF2 by decoding the plurality of substream data YSS, C1SS and C2SS at the second output frame frequency OFF2 when the still image is detected.

As described above, in the display device 600 according to some example embodiments, the variable frequency decoder 700 may detect the still image by comparing at least one of the plurality of substream data of the current frame and at least one of the plurality of substream data of the previous frame, and may decode the plurality of substream data at the second output frame frequency OFF2 lower than the input frame frequency IFF when the still image is detected. Accordingly, the power consumption of the display device 600 according to some example embodiments may be reduced.

Figure 12:
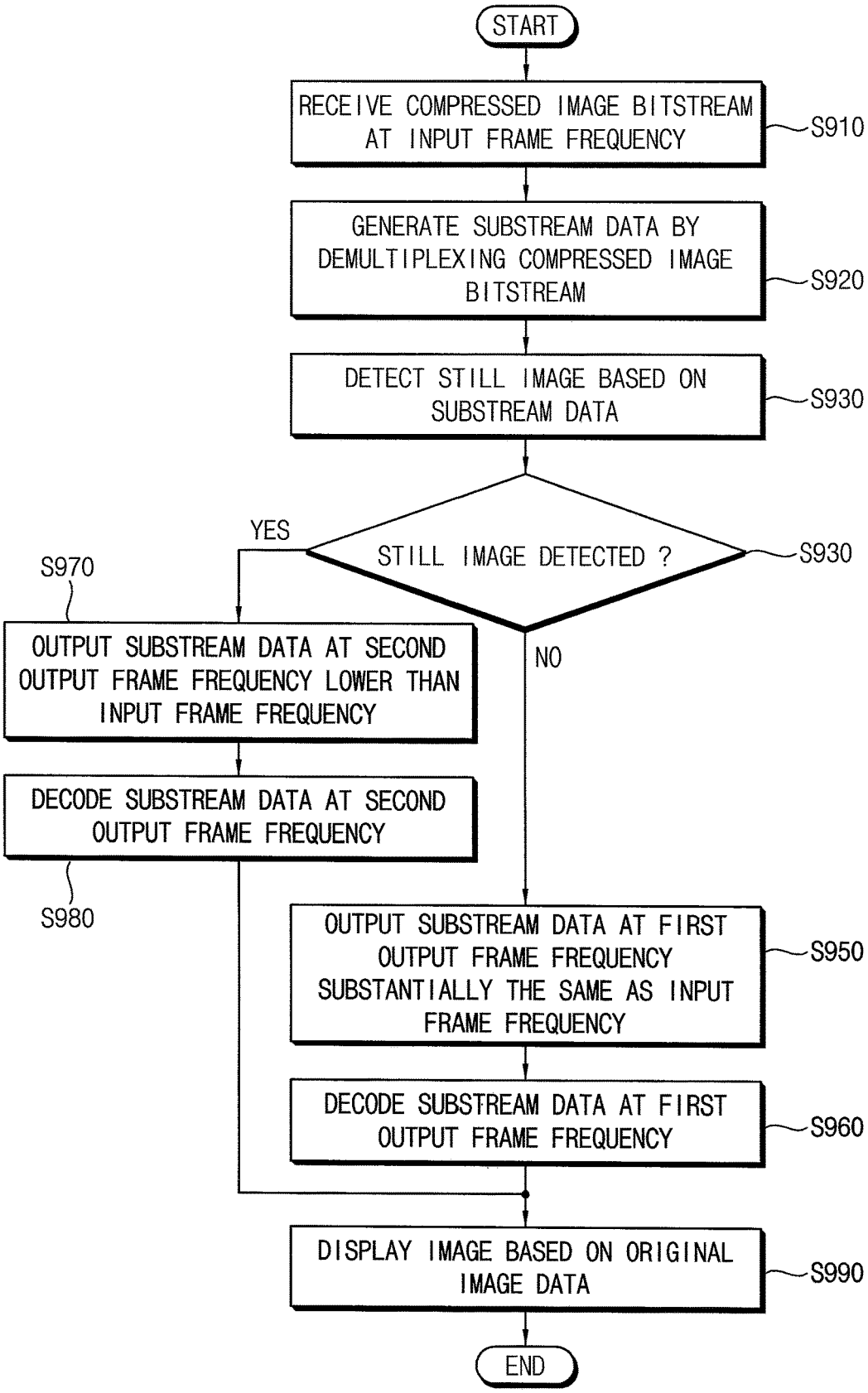
FIG. 12 is a flowchart illustrating a method of operating a display device according to some example embodiments.

FIG. 12 is a flowchart illustrating a method of operating a display device according to some example embodiments.

Referring to FIGS. 9 and 12, a variable frequency decoder 700 of a display device 600 may receive a compressed image bitstream CIBS at an input frame frequency IFF from a host processor 300 (S910), may generate a plurality of substream data by demultiplexing the compressed image bitstream CIBS (S920), and may detect a still image based on the plurality of substream data (S930).

According to some example embodiments, the variable frequency decoder 700 may generate the plurality of substream data by demultiplexing the compressed image bitstream CIBS, may store at least one of the plurality of substream data of a previous frame in a substream memory, may compare at least one of the plurality of substream data of a current frame and the at least one of the plurality of substream data of the previous frame stored in the substream memory, may determine that the still image is not detected when the at least one of the plurality of substream data of the current frame is different from the at least one of the plurality of substream data of the previous frame, and may determine that the still image is detected when the at least one of the plurality of substream data of the current frame is substantially the same as the at least one of the plurality of substream data of the previous frame.

According to some example embodiments, the variable frequency decoder 700 may generate the plurality of substream data by demultiplexing the compressed image bitstream CIBS, may store a previous representative value of at least one of the plurality of substream data of the previous frame in a representative value register, may calculate a current representative value of at least one of the plurality of substream data of the current frame, may compare the current representative value and the previous representative value stored in the representative value register, may determine that the still image is not detected when the current representative value is different from the previous representative value, and may determine that the still image is detected when the current representative value is substantially the same as the previous representative value.

When the still image is not detected (S940: NO), a driving frequency changing unit of the variable frequency decoder 700 may output the plurality of substream data at a first output frame frequency OFF1 substantially the same as the input frame frequency IFF (S950), and a substream decoding unit of the variable frequency decoder 700 may generate original image data OID at the first output frame frequency OFF1 by decoding the plurality of substream data at the first output frame frequency OFF1 (S960). Thus, a controller 140 may provide the original image data OID to a data driver 120 at the first output frame frequency OFF1, and the data driver 120 may drive a display panel 110 at the first output frame frequency OFF1 substantially the same as the input frame frequency IFF based on the original image data OID to display an image (S990).

When the still image is detected (S940: YES), a driving frequency changing unit of the variable frequency decoder 700 may output the plurality of substream data at a second output frame frequency OFF2 lower than the input frame frequency IFF (S970), and the substream decoding unit of the variable frequency decoder 700 may generate the original image data OID at the second output frame frequency OFF2 by decoding the plurality of substream data at the second output frame frequency OFF2 (S980). Thus, the controller 140 may provide the original image data OID to the data driver 120 at the second output frame frequency OFF2, and the data driver 120 may drive the display panel 110 at the second output frame frequency OFF2 lower than the input frame frequency IFF based on the original image data OID to display an image (S990). Accordingly, while the still image is displayed in the display device 600 according to some example embodiments, the variable frequency decoder 700 may perform the decoding at the second output frame frequency OFF2 lower than the input frame frequency IFF, and the display panel 100 may be driven or refreshed at the second output frame frequency OFF2 lower than the input frame frequency IFF, thereby reducing the power consumption of the display device 600.

Figure 13:
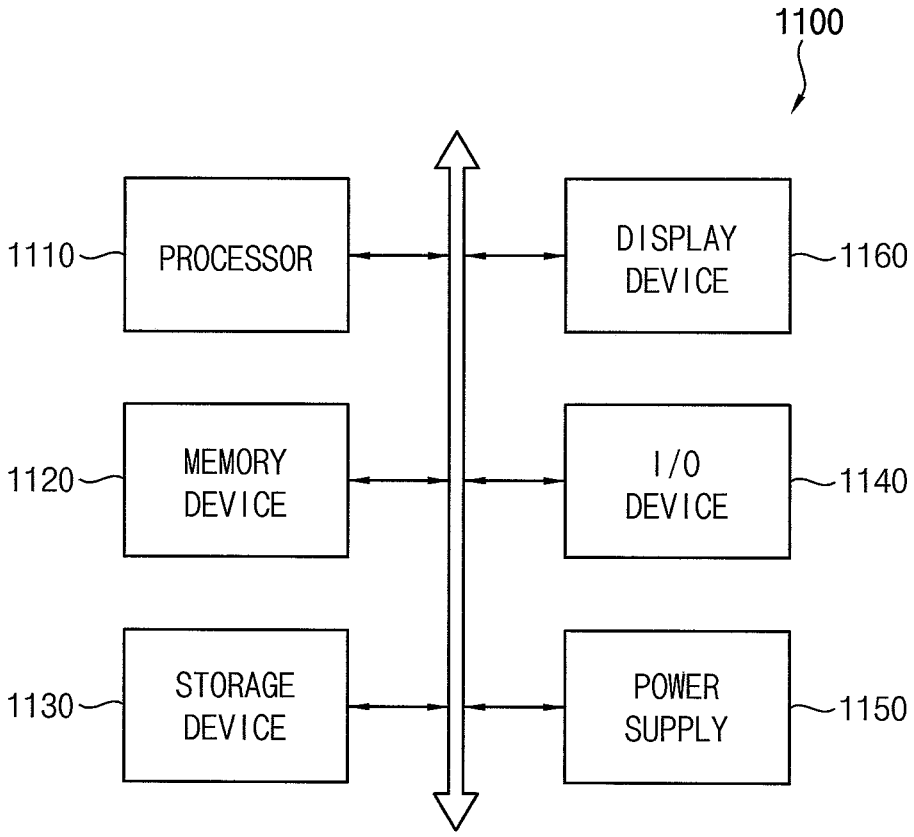
FIG. 13 is an electronic device including a display device according to some example embodiments.

FIG. 13 is an electronic device including a display device according to some example embodiments.

Referring to FIG. 13, an electronic device 1100 may include a processor 1110, a memory device 1120, a storage device 1130, an input/output (I/O) device 1140, a power supply 1150, and a display device 1160. The electronic device 1100 may further include a plurality of ports for communicating a video card, a sound card, a memory card, a universal serial bus (USB) device, other electric devices, etc.

The processor 1110 may perform various computing functions or tasks. The processor 1110 may be an application processor (AP), a micro processor, a central processing unit (CPU), etc. The processor 1110 may be coupled to other components via an address bus, a control bus, a data bus, etc. Further, according to some example embodiments, the processor 1110 may be further coupled to an extended bus such as a peripheral component interconnection (PCI) bus.

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile dynamic random access memory (mobile DRAM) device, etc.

The storage device 1130 may be a solid state drive (SSD) device, a hard disk drive (HDD) device, a CD-ROM device, etc. The I/O device 1140 may be an input device such as a keyboard, a keypad, a mouse, a touch screen, etc, and an output device such as a printer, a speaker, etc. The power supply 1150 may supply power for operations of the electronic device 1100. The display device 1160 may be coupled to other components through the buses or other communication links.

In the display device 1160 according to some example embodiments, a still image detector may detect a still image by comparing a compressed image bitstream of a current frame and the compressed image bitstream of a previous frame, and a decoder may decode the compressed image bitstream at an output frame frequency lower than an input frame frequency when the still image is detected. In the display device 1160 according to some example embodiments, a variable frequency decoder may detect the still image by comparing at least one of a plurality of substream data of the current frame and at least one of the plurality of substream data of the previous frame, and may decode the plurality of substream data at the output frame frequency lower than the input frame frequency when the still image is detected. Accordingly, the power consumption of the display device 1160 according to some example embodiments may be reduced.

The inventive concepts may be applied to any display device 1160, and any electronic device 1100 including the display device 1160. For example, the inventive concepts may be applied to a mobile phone, a smart phone, a wearable electronic device, a tablet computer, a television (TV), a digital TV, a 3D TV, a personal computer (PC), a home appliance, a laptop computer, a personal digital assistant (PDA), a portable multimedia player (PMP), a digital camera, a music player, a portable game console, a navigation device, etc.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

The foregoing is illustrative of example embodiments and is not to be construed as limiting thereof. Although aspects of some example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims, and their equivalents.

What is claimed is:

1. A display device comprising:

a display panel including a plurality of pixels; and a display driver configured to drive the display panel, wherein the display driver includes:

a still image detector configured to receive a compressed image bitstream at an input frame frequency from a host processor, and to detect a still image by comparing the compressed image bitstream of a current frame and the compressed image bitstream of a previous frame;

a driving frequency changer configured to output the compressed image bitstream at a first output frame frequency equal to the input frame frequency when the still image is not detected, and to output the compressed image bitstream at a second output frame frequency lower than the input frame frequency when the still image is detected; and a decoder configured to generate original image data at the first output frame frequency by decoding the compressed image bitstream at the first output frame frequency when the still image is not detected, and to generate the original image data at the second output frame frequency by decoding the compressed image bitstream at the second output frame frequency when the still image is detected.

2. The display device of claim 1, wherein the still image detector includes:

a bitstream memory configured to store the compressed image bitstream of the previous frame; and a still image detecting unit configured to compare the compressed image bitstream of the current frame received from the host processor and the compressed image bitstream of the previous frame stored in the bitstream memory, to determine that the still image is not detected when the compressed image bitstream of the current frame is different from the compressed image bitstream of the previous frame, and to determine that the still image is detected when the compressed image bitstream of the current frame corresponds to the compressed image bitstream of the previous frame.

3. The display device of claim 1, wherein the still image detector includes:

a representative value register configured to store a previous representative value of the compressed image bitstream of the previous frame; and a still image detecting unit configured to calculate a current representative value of the compressed image bitstream of the current frame received from the host processor, to compare the current representative value and the previous representative value stored in the representative value register, to determine that the still image is not detected when the current representative value is different from the previous representative value, and to determine that the still image is detected when the current representative value corresponds to the previous representative value.

4. The display device of claim 1, wherein the driving frequency changer is configured such that, when the still image is not detected, the driving frequency changer outputs the compressed image bitstream of N frames while the compressed image bitstream of the N frames is input, where N is an integer greater than 1, and wherein the driving frequency changer is configured such that, when the still image is detected, the driving frequency changer outputs the compressed image bitstream of M frames while the compressed image bitstream of the N frames is input, where M is an integer greater than 0 and less than N.

5. The display device of claim 1, wherein the input frame frequency is K Hz, and the second output frame frequency is L Hz, where K is an integer greater than 1, and L is an integer greater than 0 and less than K, wherein the driving frequency changer is configured such that, when the still image is not detected, the driving frequency changer outputs the compressed image bitstream of K frames for 1 second, and wherein the driving frequency changer is configured such that, when the still image is detected, the driving frequency changer outputs the compressed image bitstream of L frames for 1 second, and does not output the compressed image bitstream of K-L frames for the 1 second.

6. The display device of claim 1, wherein the decoder includes:

a rate buffer configured to temporarily store the compressed image bitstream;

a substream demultiplexing unit configured to generate a plurality of substream data for a luminance component, a first chrominance component and a second chrominance component by demultiplexing the compressed image bitstream;

an entropy decoding unit configured to generate at least one of residual values, indexed color history (ICH) index data and flatness information by performing entropy decoding on the plurality of substream data;

a rate control unit configured to determine a quantization parameter based on at least one of a number of bits used in a current prediction and the flatness information;

a prediction-inverse quantization-reconstruction unit configured to generate prediction values for a pixel group, to inverse quantize the residual values from the entropy decoding unit based on the quantization parameter, and to generate pixel values for the pixel group by adding the inverse quantized residual values to the prediction values;

an ICH unit configured to perform ICH decoding for the pixel group based on the ICH index data from the entropy decoding unit;

a line buffer configured to store the pixel values for a previous line; and an image format converter configured to generate the original image data by converting a format of the pixel values output from the prediction-inverse quantization-reconstruction unit.

7. A display device comprising:

a display panel including a plurality of pixels; and a display driver configured to drive the display panel, wherein the display driver includes:

a variable frequency decoder configured to:

receive a compressed image bitstream at an input frame frequency from a host processor;

generate a plurality of substream data by demultiplexing the compressed image bitstream;

detect a still image by comparing at least one of the plurality of substream data of a current frame and at least one of the plurality of substream data of a previous frame;

generate original image data at a first output frame frequency equal to the input frame frequency by decoding the plurality of substream data at the first output frame frequency when the still image is not detected; and generate the original image data at a second output frame frequency lower than the input frame frequency by decoding the plurality of substream data at the second output frame frequency when the still image is detected.

8. The display device of claim 7, wherein the variable frequency decoder includes:

a substream demultiplexing unit configured to generate the plurality of substream data for a luminance component, a first chrominance component and a second chrominance component by demultiplexing the compressed image bitstream;

a substream memory configured to store the at least one of the plurality of substream data of the previous frame;

a still image detecting unit configured to compare the at least one of the plurality of substream data of the current frame received from the substream demultiplexing unit and the at least one of the plurality of substream data of the previous frame stored in the substream memory, to determine that the still image is not detected when the at least one of the plurality of substream data of the current frame is different from the at least one of the plurality of substream data of the previous frame, and to determine that the still image is detected when the at least one of the plurality of substream data of the current frame corresponds to the at least one of the plurality of substream data of the previous frame;

a driving frequency changing unit configured to output the plurality of substream data at the first output frame frequency when the still image is not detected, and to output the plurality of substream data at the second output frame frequency when the still image is detected; and a substream decoding unit configured to generate the original image data at the first output frame frequency by decoding the plurality of substream data at the first output frame frequency when the still image is not detected, and to generate the original image data at the second output frame frequency by decoding the plurality of substream data at the second output frame frequency when the still image is detected.

9. The display device of claim 8, wherein the driving frequency changing unit is configured such that, when the still image is not detected, the driving frequency changing unit outputs the plurality of substream data of N frames while the plurality of substream data of the N frames is input, where N is an integer greater than 1, and wherein the driving frequency changing unit is configured such that, when the still image is detected, the driving frequency changing unit outputs the plurality of substream data of M frames while the plurality of substream data of the N frames is input, where M is an integer greater than 0 and less than N.

10. The display device of claim 8, wherein the input frame frequency is K Hz, and the second output frame frequency is L Hz, where K is an integer greater than 1, and L is an integer greater than 0 and less than K, wherein the driving frequency changing unit is configured such that, when the still image is not detected, the driving frequency changing unit outputs the plurality of substream data of K frames for 1 second, and wherein the driving frequency changing unit is configured such that, when the still image is detected, the driving frequency changing unit outputs the plurality of substream data of L frames for 1 second, and does not output the plurality of substream data of K-L frames for the 1 second.

11. The display device of claim 8, wherein the variable frequency decoder further includes:

a rate buffer configured to temporarily store the compressed image bitstream received from the host processor, and to output the temporarily stored compressed image bitstream to the substream demultiplexing unit.

12. The display device of claim 8, wherein the substream decoding unit includes:

an entropy decoding unit configured to generate at least one of residual values, indexed color history (ICH) index data and flatness information by performing entropy decoding on the plurality of substream data;

a rate control unit configured to determine a quantization parameter based on at least one of a number of bits used in a current prediction and the flatness information;

a prediction-inverse quantization-reconstruction unit configured to generate prediction values for a pixel group, to inverse quantize the residual values from the entropy decoding unit based on the quantization parameter, and to generate pixel values for the pixel group by adding the inverse quantized residual values to the prediction values;

an ICH unit configured to perform ICH decoding for the pixel group based on the ICH index data from the entropy decoding unit;

a line buffer configured to store the pixel values for a previous line; and an image format converter configured to generate the original image data by converting a format of the pixel values output from the prediction-inverse quantization-reconstruction unit.

13. The display device of claim 7, wherein the variable frequency decoder includes:

a substream demultiplexing unit configured to generate the plurality of substream data for a luminance component, a first chrominance component and a second chrominance component by demultiplexing the compressed image bitstream;

a representative value register configured to store a previous representative value of the at least one of the plurality of substream data of the previous frame;

a still image detecting unit configured to calculate a current representative value of the at least one of the plurality of substream data of the current frame received from the substream demultiplexing unit, to compare the current representative value and the previous representative value stored in the representative value register, to determine that the still image is not detected when the current representative value is different from the previous representative value, and to determine that the still image is detected when the current representative value corresponds to the previous representative value;

a driving frequency changing unit configured to output the plurality of substream data at the first output frame frequency when the still image is not detected, and to output the plurality of substream data at the second output frame frequency when the still image is detected; and a substream decoding unit configured to generate the original image data at the first output frame frequency by decoding the plurality of substream data at the first output frame frequency when the still image is not detected, and to generate the original image data at the second output frame frequency by decoding the plurality of substream data at the second output frame frequency when the still image is detected.

14. A method of operating a display device, the method comprising:

receiving a compressed image bitstream at an input frame frequency from a host processor;

detecting a still image by comparing the compressed image bitstream of a current frame and the compressed image bitstream of a previous frame;

generating original image data at a first output frame frequency equal to the input frame frequency by decoding the compressed image bitstream at the first output frame frequency when the still image is not detected;

generating the original image data at a second output frame frequency lower than the input frame frequency by decoding the compressed image bitstream at the second output frame frequency when the still image is detected; and displaying an image based on the original image data.

15. The method of claim 14, wherein detecting the still image includes:

storing the compressed image bitstream of the previous frame in a bitstream memory;

comparing the compressed image bitstream of the current frame received from the host processor and the compressed image bitstream of the previous frame stored in the bitstream memory;

determining that the still image is not detected when the compressed image bitstream of the current frame is different from the compressed image bitstream of the previous frame; and determining that the still image is detected when the compressed image bitstream of the current frame corresponds to the compressed image bitstream of the previous frame.

16. The method of claim 14, wherein detecting the still image includes:

storing a previous representative value of the compressed image bitstream of the previous frame in a representative value register;

calculating a current representative value of the compressed image bitstream of the current frame received from the host processor;

comparing the current representative value and the previous representative value stored in the representative value register;

determining that the still image is not detected when the current representative value is different from the previous representative value; and determining that the still image is detected when the current representative value corresponds to the previous representative value.

17. The method of claim 14, wherein detecting the still image includes:

generating a plurality of substream data by demultiplexing the compressed image bitstream;

storing at least one of the plurality of substream data of the previous frame in a substream memory;

comparing at least one of the plurality of substream data of the current frame and the at least one of the plurality of substream data of the previous frame stored in the substream memory;

determining that the still image is not detected when the at least one of the plurality of substream data of the current frame is different from the at least one of the plurality of substream data of the previous frame; and determining that the still image is detected when the at least one of the plurality of substream data of the current frame corresponds to the at least one of the plurality of substream data of the previous frame.

18. The method of claim 14, wherein detecting the still image includes:

generating a plurality of substream data by demultiplexing the compressed image bitstream;

storing a previous representative value of at least one of the plurality of substream data of the previous frame in a representative value register;

calculating a current representative value of at least one of the plurality of substream data of the current frame;

comparing the current representative value and the previous representative value stored in the representative value register;

determining that the still image is not detected when the current representative value is different from the previous representative value; and determining that the still image is detected when the current representative value corresponds to the previous representative value.

19. The method of claim 14, wherein the compressed image bitstream of N frames is received for a first time, where N is an integer greater than 1, and wherein generating the original image data at the second output frame frequency includes:

outputting the compressed image bitstream of M frames for the first time, where M is an integer greater than 0 and less than N; and generating the original image data of the M frames by decoding the compressed image bitstream of the M frames for the first time.

20. The method of claim 14, wherein the input frame frequency is K Hz, and the second output frame frequency is L Hz, where K is an integer greater than 1, and L is an integer greater than 0 and less than K, and wherein generating the original image data at the second output frame frequency includes:

outputting the compressed image bitstream of L frames for 1 second;

preventing the compressed image bitstream of K-L frames from being output for the 1 second; and generating the original image data of the L frames by decoding the compressed image bitstream of the L frames for the 1 second.

* * * * *